US006372973B1

(12) United States Patent
Schneider

(10) Patent No.: US 6,372,973 B1
(45) Date of Patent: Apr. 16, 2002

(54) MUSICAL INSTRUMENTS THAT GENERATE NOTES ACCORDING TO SOUNDS AND MANUALLY SELECTED SCALES

(75) Inventor: M. Bret Schneider, Portola Valley, CA (US)

(73) Assignee: Schneidor Medical Technologies, Inc,, West Lake Village, CA (US)

( * ) Notice: Subject to any disclaimer, the term of this patent is extended or adjusted under 35 U.S.C. 154(b) by 0 days.

(21) Appl. No.: 09/315,384

(22) Filed: May 18, 1999

(51) Int. Cl.[7] ..... G10H 7/00

(52) U.S. Cl. ..... 84/609; 84/622; 84/649; 84/659

(58) Field of Search ..... 84/622–625, 627, 84/645, 659–660, 723, 633, 665, 609–610, 649–650, 685, 619

(56) References Cited

U.S. PATENT DOCUMENTS

| | | | | |
|---|---|---|---|---|
| 3,539,701 A | | 11/1970 | Milde | 84/1.28 |
| 3,634,596 A | | 1/1972 | Rupert | 84/1.28 |
| 3,999,456 A | | 12/1976 | Tsunoo et al. | 84/1.01 |
| 4,313,361 A | | 2/1982 | Deutsch | 84/1.01 |
| 4,377,961 A | | 3/1983 | Bode | 84/1.01 |
| 4,441,399 A | | 4/1984 | Wiggins et al. | 84/470 |
| 4,463,650 A | | 8/1984 | Rupert | 84/1.19 |
| 4,633,748 A | | 1/1987 | Takashima et al. | 84/1.01 |
| 4,771,671 A | | 9/1988 | Hoff, Jr. | 84/1.01 |
| 5,129,303 A | * | 7/1992 | Coles | 84/685 |
| 5,808,225 A | * | 9/1998 | Corwin et al. | 84/622 |
| 5,854,438 A | * | 12/1998 | Assayag et al. | 84/625 |
| 5,902,951 A | * | 5/1999 | Kondo et al. | 84/610 |

FOREIGN PATENT DOCUMENTS

| | | |
|---|---|---|
| EP | 0142935 | 1/1985 |

* cited by examiner

*Primary Examiner*—Marlon T. Fletcher
(74) *Attorney, Agent, or Firm*—Ritter, Lang & Kaplan LLP

(57) ABSTRACT

Musical instruments that generate notes according to sounds (e.g., vocal sounds) and manually selected scales are provided. Vocal sounds of the user are analyzed to select a note that will be generated in a scale selected by the user. The user can enter the scale or scale constraints by depressing a chord on a keyboard and the vocal sounds can be analyzed to determine which note on the selected scale is closest in pitch to the vocal sounds. Additionally, the generated notes can be augmented in other ways including having the onset and/or offset of the note generated adjusted to correspond to an identified rhythm in the ambient sounds.

29 Claims, 4 Drawing Sheets

MUSICAL INSTRUMENTS THAT GENERATE NOTES ACCORDING TO SOUNDS AND MANUALLY SELECTED SCALES

BACKGROUND OF THE INVENTION

The present invention relates to musical instruments and methods of producing sounds. More specifically, the invention relates to techniques for transforming sounds (e.g., vocal sounds) into musical notes in accordance with musical scales that are manually selected in real-time.

The computer revolution has brought a plethora of new technologies to the world of music. Some of these new technologies allow musicians to effortlessly produce precise tones and pitches. These advances allow musicians to focus on music, rather than on the mechanics of producing a specific sound.

For example, conventional electronic keyboards provide musicians with an almost infinite number of musical combinations at their fingertips. Musicians are able to select the specific sounds that will be generated when the keys on the keyboard are depressed including different musical instruments, voices, sound effects, and the like. Additionally, musicians are able to specify one or more rhythms or accompanying scores for the music. These are just a few examples of the wide range of special effects that are available on conventional electronic keyboards.

The notes generated by an electric keyboard are generally initiated by depressing the keys. However, there are other electronic musical instruments that allow musicians to generate notes based on vocal sounds. For example, the "Vocalizer 1000" from Breakaway Music Systems in San Mateo, Calif. takes voice input and converts the vocal sounds to Musical Instrument Digital Interface (MIDI) signals or digital codes. The Vocalizer 1000 applies a "lock-to-scale" function to the signals generated so that they are confined to being on the scales of a predesignated song pattern that is selected by the musician before beginning the input of the vocal sounds. However, at least one shortcoming of conventional electronic musical instruments such as the Vocalizer 1000 is that the musician is not afforded the capability of selecting the desired scales in real-time.

It would be desirable to have an electronic musical instrument that receives vocal sound input from a musician and produces musical notes that are constrained to a scale that is selected by the musician in real-time. It would also be desirable to provide an electronic musical instrument that is sensitive not just to the pitch of the vocal sound input, but also the volume and tonal qualities of the musician's voice so this information can be utilized to shape the notes that are output. Additionally, it would be desirable to have an electronic musical instrument that can "listen" to ambient sounds or music in order to identify a dominant rhythm and to use this information to shape temporal aspects of the musical output.

SUMMARY OF THE INVENTION

The present invention provides musical instruments that generate notes according to sounds that are input and musical scales that are selected in real-time. For example, vocal sounds from a user can be converted to a digital signal that is then received by digital signal processing circuitry. The circuitry can receive input that specifies a scale to which generated notes should be constrained. The desired scales can be selected by a user at any time (e.g., during a song in real-time). Additionally, the circuitry can analyze aspects of the vocal sounds such as volume or tonal qualities to shape the notes that are output. The circuitry can also receive ambient sound signals that can be analyzed in order to identify a rhythm so that the notes can be modified in accordance with this rhythm. Accordingly, the invention allows users to use technology to generate the notes, but allows the user to utilize his or her own voice or vocal sounds to personalize the generated notes similar to playing a traditional musical instrument. Some specific embodiments of the invention are described below.

In one embodiment, the invention provides a musical instrument that is directed by sounds from a user. A transducer receives a series of sounds from the user and converts the sounds to electric signals. The instrument includes multiple switches that allow the user to sequentially select musical scales. A processor receives the electric signals from the transducer and modifies the electric signals to represent notes on the currently selected musical scale from the switches. The processor can also set the volume of the notes in the electric signals to be proportional to the volume of the sounds. Additionally, the processor can receive other electric signals corresponding to ambient sounds and identify a rhythm in these electric signals so that the onset and/or offset of the notes can be set in accordance with rhythm that is identified in the ambient sounds. In a preferred embodiment, the sounds from the user are vocal sounds.

In another embodiment, the invention provides a method of producing sounds according to sounds from a user. Electric signals corresponding to a series of sounds are received from the user. Also, input is received from the user that sequentially selects musical scales. The electric signals are modified to correspond to notes on the currently selected musical scale that is closest in pitch. In a preferred embodiment, the electric signals are MIDI signals.

Other features and advantages of the invention will become readily apparent upon review of the following description in association with the accompanying drawings.

DETAILED DESCRIPTION OF PREFERRED EMBODIMENTS

In the description that follows, the present invention will be described in reference to embodiments receive vocal sounds and generate notes that conform to musical scale constraints that have been designated in real-time. More specifically, the embodiments will be described in reference to a preferred embodiment that resembles a conventional saxophone and utilizes a keyboard to designate the desired scale. However, embodiments of the invention are not limited to any particular input, configuration, architecture, circuitry, or specific implementation. Therefore, the description of the embodiments that follows is for purposes of illustration and not limitation.

Figure 1:
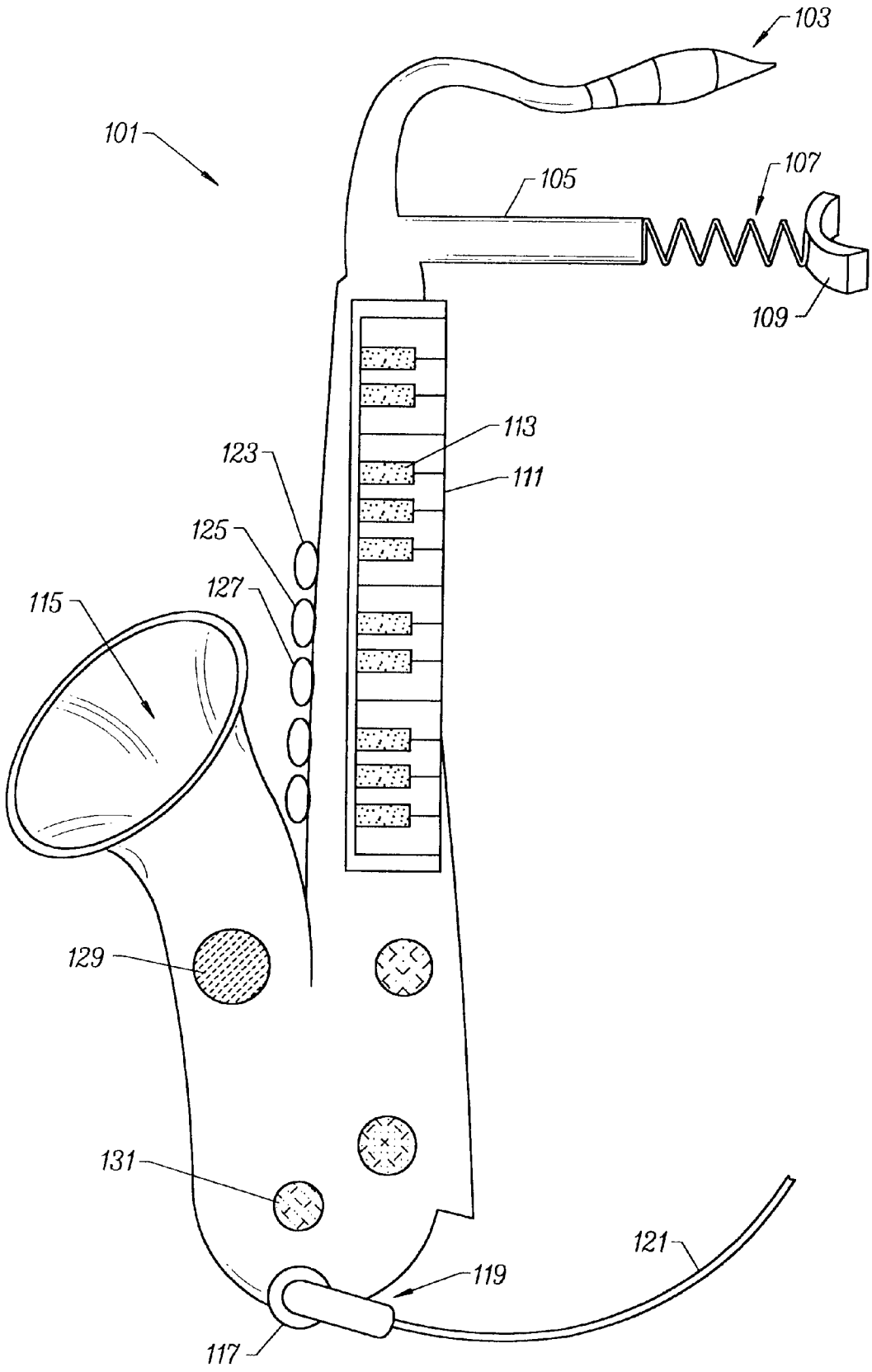
FIG. 1 shows an embodiment of the invention that resembles a saxophone.

FIG. 1 shows a musical instrument that receives vocal sounds and generates notes that are constrained to a scale that is selected via a keyboard in real-time by a user. A musical instrument 101 resembles a traditional saxophone and includes a mouthpiece 103 through which the user can hum or blow. Below mouth piece 103 is an extension 105 that places a microphone or transducer near the larynx or throat of the user. For enhanced custom and fit, a spring 107 and a pad 109 are utilized to hold the microphone on the throat of the user. Since the microphone is used to pickup the vocal sounds of the user, mouse piece 103 is not strictly necessary but users may find that blowing into the mouthpiece makes it easier to produce the desired vocal sounds. In other embodiments, the microphone can be placed in or near mouthpiece 103.

Musical instrument 101 includes a keyboard 111 that includes multiple keys 113. Keyboard 111 is manipulated by the fingers of the user in order to designate a desired scale. Scales such as C major can be input utilizing a single key. However, in preferred embodiments, scales are selected by "fingering" a chord that specifies the desired scale. For example, if the user wishes to produce notes that are best harmonized by C major chord, the user can simultaneously depress keys for the notes C, E and G so that the C major scale is specified. Keyboard 111 allows the user to sequentially select musical scales that are desired.

Circuitry within musical instrument 101 receives vocal sounds from the user and a concurrently designated scale from the user via keyboard 111 to generate notes constrained in the desired scale that are closest to the pitch or frequency of the received vocal sounds. The generated notes can emanate from an opening 115 of the musical instrument. Additionally, musical instrument 101 can include a jack 117 through which signals corresponding to the notes can be transmitted to an external device such as an amplifier (not shown) via a cable 121.

Musical instrument 101 can include many different controls such as the following. A control knob 123 can be activated by the user to shift the notes that are generated one octave up. Similarly, a control knob 125 can be activated by the user to shift the generated notes one octave down. A control knob 127 can be activated by the user to turn off the "lock-to-scale" functions that are being performed by musical instrument 101. Other control knobs can be provided to produce other special effects such as flutter notes, bass/treble tone control, automatic harmony voice, and the like.

Musical instrument 101 can also include dials that allow the user to further specify how the generated notes or sounds will be perceived. A dial 129 can be manipulated by the user in order to specify the MIDI instrument or voice that will be utilized to generate the notes or sounds produced by the musical instrument. A dial 131 can be utilized by the user to adjust the volume of the sounds produced by the musical instrument. Other dials can be utilized for other functions including those described above.

Figure 2:
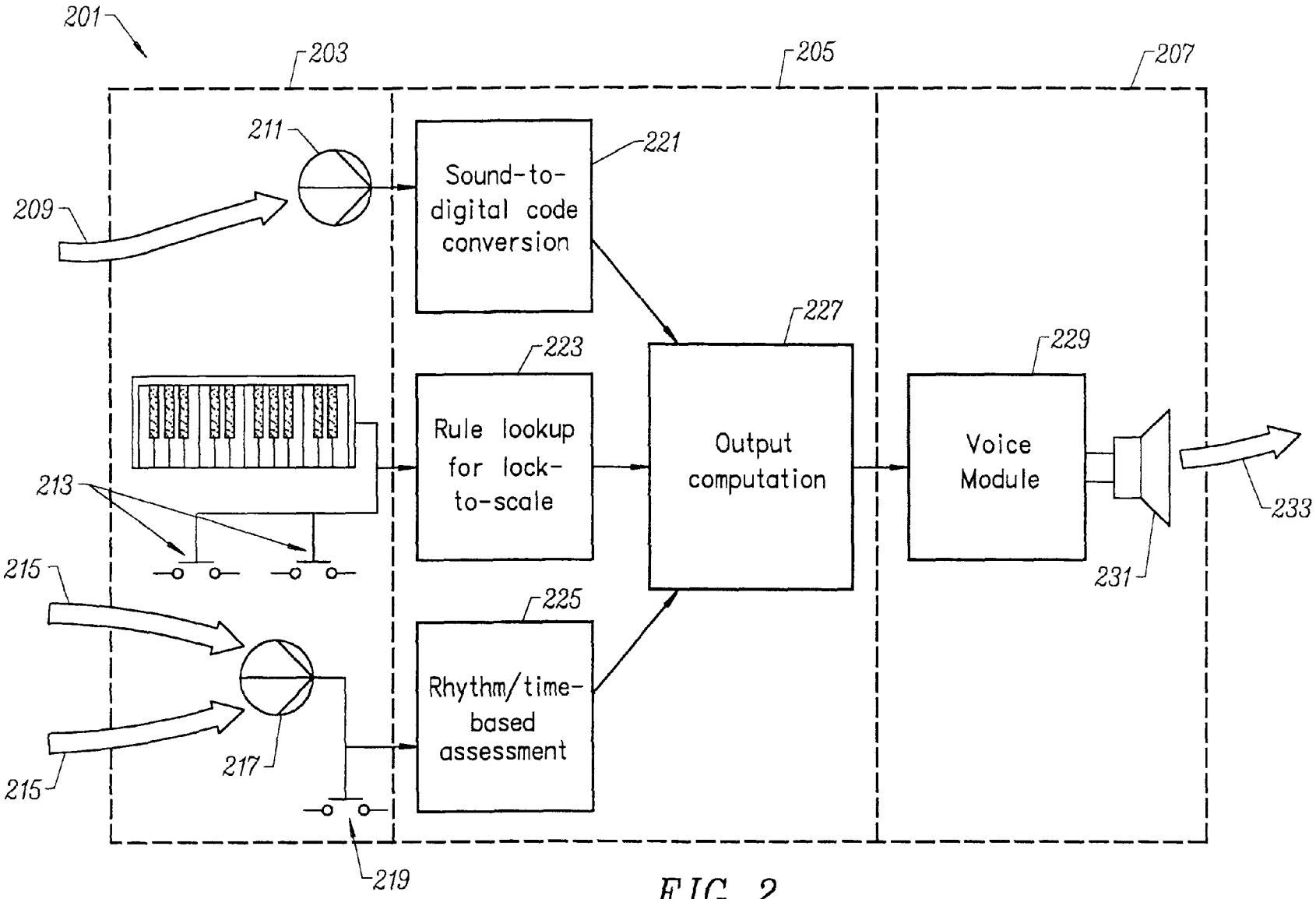
FIG. 2 shows a block diagram of circuitry of one embodiment of the invention.

Now that the overall appearance of the musical instrument of FIG. 1 has been described, it may be beneficial now to describe in some detail how the circuitry performs the desired functions. FIG. 2 shows a block diagram of circuitry that can be utilized to generate notes or sounds according to the present invention. Digital circuitry 201 can be broken down into three functional blocks: an input block 203, a processing block 205 and an output block 207.

Vocal sounds 209 are detected by a transducer 211 that converts the vocal sounds to a series of electric signals. Transducer 211 can be a microphone or similar device including magnetic pickups and piezoelectric elements. As an example, U.S. Pat. No. 5,171,930 describes a transduction device that converts vibrations of the external aspect of the human larynx into electronic signals that are available for further processing. Additionally, U.S. Pat. No. 5,563,361 describes mechanisms for pitch detection and conversion. The disclosures of these and any other patents or papers mentioned herein are hereby incorporated by reference.

Input block 203 includes multiple switches 213 that a user can activate to select a desired scale. The switches can resemble a conventional keyboard or other switch arrays that are known in the art.

In one aspect of the invention, ambient sounds 215 are detected by a transducer 217. Transducer 217 converts the ambient sounds into electric signals similar to transducer 211. Additionally, a switch 219 can be activated by the user to manually cue the instrument with a rhythm, such as by rhythmically tapping the switch.

Now that input block 203 has been described, processing block 205 will be described in more detail. Processing block 205 includes analog-to-digital code conversion circuitry 221 that converts the analog electric signals from transducer 211 to digital signals, such as MIDI signals. An appropriately programmed analog-to-digital converter can be utilized to produce the digital codes. Devices that can be utilized include "Sound2MIDI" software from Audioworks Ltd., London, UK, the "Axon" device for piezo pickups from BlueChip Music/Music Industries Corp., Floral Park, N.Y., the "MX101" device by Hollis Research (http://www.hollis.co.uk), Wildcat Canyon "Autoscore" products from MIDIWare Systems, Clearwater, Fla., "Amadeus al fine" hardware/software systems (Http://www.jwpepper.com/dec97 netnotes.amadeus.html), the "G50" device by Yamaha, the "Pitchrider" device by IVL in Canada, and the "GI-10" device by Roland.

Typically, a rule look up for lock-to-scale circuitry 223 receives electrical signals from switch 213 that specify the desired scale (e.g., via a chord) so that the allowed notes can be identified. Circuitry 223 generates signals indicating the notes that are allowed in the desired scale.

A rhythm/time-based assessment circuitry 225 receives electric signals that include an underlying rhythm (if one is present). Circuitry 225 identifies the rhythm and produces electric signals that specify the detected rhythm in ambient sounds 215 or the manual tapping of switch 219. The rhythm can be identified in a number of ways including those described in U.S. Pat. No. 5,146,833 that describes a method of encoding and inputting rhythm information into a musical data processing system, which is hereby incorporated by reference.

Output computations circuitry 227 receives electric signals from circuitry 221, 223 and 225. Circuitry 227 receives signals from circuitry 221 that correspond to the vocal sounds produced by the user. Circuitry 227 receives electric signals from circuitry 223 that indicate the allowed notes for the desired scale.

It is determined which of the allowed notes in the desired scale is closest in pitch to the vocal sounds generated by the user and this note is generated. Signals from circuitry 225 specifying a detected (or manually input) rhythm can be utilized the augment the onset and/or offset of the generated notes so that are in accordance with the detected rhythm. The signals received by circuitry 27 are typically digital signals, however, the invention can also be realized utilizing analog signals where desired. The electric signals generated by circuitry 227 are preferably digital signals and more preferably MIDI signals.

In output block 207, voice module circuitry 229 receives the signals from circuitry 227 and generates analog signals that can be transmitted to a speaker 213 in order to produce the desired notes 233. As described before in reference to FIG. 1, circuitry 229 can receive inputs such as the desired MIDI instrument or voice that should be utilized to generate the notes.

In the MIDI standard, musical notes are represented by digital codes. Encoded information includes a number of parameters including pitch and timing (e.g., onset and offset). Voice module 229 can include submodules that interpret MIDI codes, access data banks of digitally sample instrument sounds, and output analog notes or music in accordance with the MIDI code. The notes produced, for example, can have the characteristics of the selected instrument such as a piano, guitar, saxophone, drums, special effects, and the like.

Figure 3:
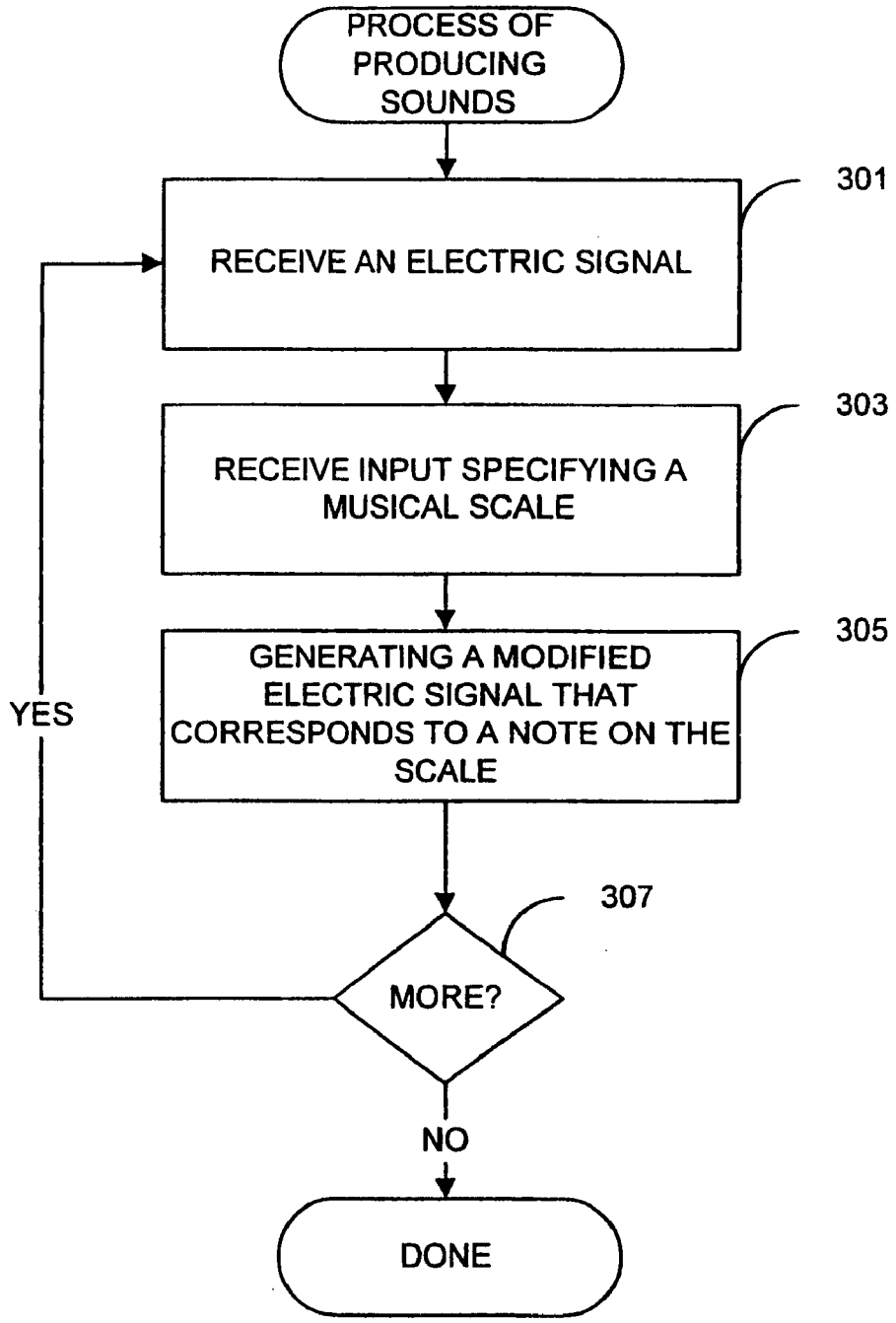
FIG. 3 shows a flow chart of a process of producing sounds in the form of a modified electric signal that corresponds to a note on a scale that is selected in real-time.

Now that the circuitry of FIG. 2 has been described, a flow chart that illustrates a process of producing sounds according to the invention will be described in reference to FIG. 3. At a step 301, an electric signal is received. Additionally, input is received that specifies a desired scale at a step 303.

Utilizing the received electric signal and desired scale, an electric signal that corresponds to a note on the scale is generated at a step 305. The note on the scale is typically selected by identifying the note that is closest in pitch (or frequency) to vocal sounds from the user and modifying the electric signal to represent that note. For example, the electrical signals can be modified according to lock-to-scale constraints of the desired scale. Lock-to-scale functions are known in the art and may be implemented such as described in U.S. Pat. No. 4,903,571, which is hereby incorporated by reference. The process of generating the modified electric signal will be described in more detail in reference to FIG. 4.

At a step 307, it is determined if there are more electric signals to process. While FIG. 3 shows that an electric signal and musical scale are received together, it should be understood that the electric signals and musical scales may be entered at different times. For example, although the user sequentially selects musical scales, there will be typically be more electric signals corresponding to vocal sounds entered than musical scales. Once the current musical scale is selected, subsequent electric signals will be constrained to that scale until another scale is selected or the keys are released.

Figure 4:
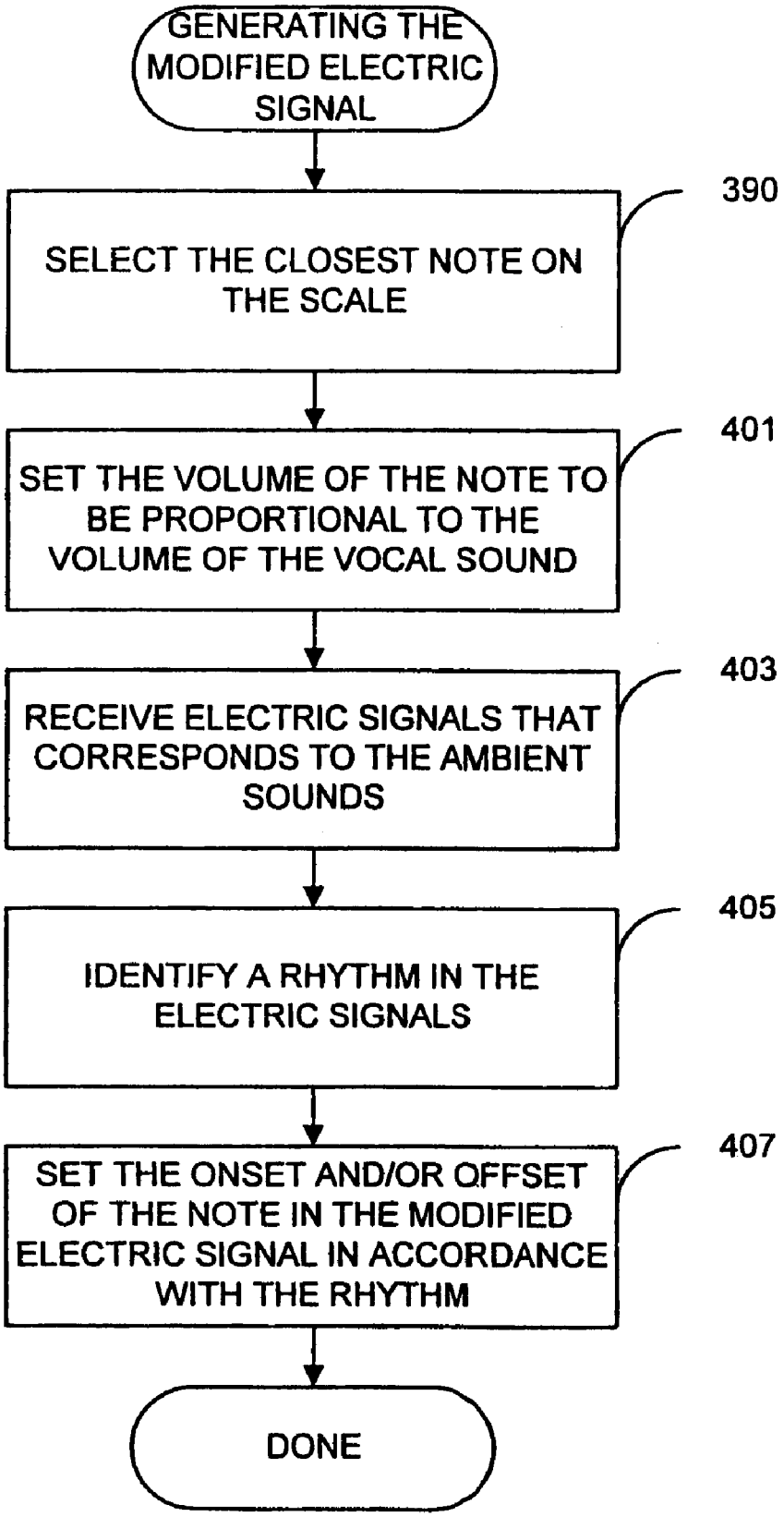
FIG. 4 shows a flow chart of a process of generating the modified electric signal of FIG. 3.

FIG. 4 shows a flow chart of a process of generating the modified electric signal. At a step 390, the note that is closest in pitch to the vocal sound (represented by an electric signal) is selected. The volume of the generated note is set to be proportional to the volume of the vocal sound at a step 401. As with all the flow charts described herein, no order should be necessarily be implied by the order in which the steps are described. Furthermore, steps can be added, deleted, reordered, and combined without departing from the spirit and scope of the invention. For example, although in preferred embodiments the volume of the vocal sounds generated by the user is utilized to set the volume of the generated notes, other embodiments need not utilize this feature.

At step 403, electric signals that correspond to the ambient sounds are received. As mentioned above, the electric signal can also be manually input by the user. The rhythm, if any, in the electric signals corresponding to the ambient sounds is identified at a step 405. Identifying the rhythm can be done in a number of different ways including those described in U.S. Pat. No. 5,403,967, which is hereby incorporated by reference.

The note on the scale that is closest to the frequency of the vocal sounds from the user is selected at a step 390. The frequency of the vocal sounds can be compared to the frequency of allowed notes in the scale and a simple calculation of which note is closest to the vocal sounds can be utilized to determine the note that will be generated. In other embodiments, more complex functions can be utilized to select the note that will be generated.

At a step 407, the onset and/or offset of the note in the modified electric signal is set in accordance with the rhythm that has been detected. This allows a user to not only play in a desired scale but also with appropriate timing of the notes.

While the above is a complete description of preferred embodiments of the invention, various alternatives, modifications, and equivalents can be used. It should be evident that the invention is equally applicable by making appropriate modifications to the embodiments described. For example, although the above has described the invention with respect to vocal sounds, the invention may be advantageously applied to embodiments that utilize other sound inputs. An embodiment of the invention can receive electric signals from a guitar or other instrument and then constrain the sound output to sequentially selected musical scales. Therefore, the above description should be taken as limiting the scope of the invention that is defined by the metes and bounds of the appended claims along with their full scope of equivalents.

What is claimed is:

1. A musical instrument, comprising:

a first transducer that receives a series of sounds from a user and converts the sounds to electric signals;

a plurality of switches that allow the user to sequentially select musical scales, each musical scale specifying notes that are on the musical scale; and a processor that receives the electric signals from the first transducer and modifies the electric signals to be constrained to represent notes on the currently selected musical scale that has been received from the plurality of switches.

2. The musical instrument of claim 1, wherein the processor sets the volume of the modified electric signals to be proportional to the volume of the sounds in the electric signals.

3. The musical instrument of claim 1, further comprising a second transducer that receives ambient sounds and converts the ambient sounds to electric signals.

4. The musical instrument of claim 3, wherein the processor receives the electric signals of ambient sounds and identifies a rhythm in the ambient sounds.

5. The musical instrument of claim 4, wherein the processor sets at least one of the onset and offset of the modified electric signals in accordance with the rhythm in the ambient sounds.

6. The musical instrument of claim 1, wherein the sounds from the user are vocals sounds.

7. The musical instrument of claim 1, wherein the modified electric signals are Musical Instrument Digital Interface (MIDI) signals.

8. The musical instrument of claim 1, wherein the plurality of switches are a keyboard.

9. The musical instrument of claim 8, wherein the scale is selected by a chord.

10. The musical instrument of claim 1, wherein the electric signals are modified to represent notes on the currently selected musical scale that are closest in pitch.

11. The musical instrument of claim 1, wherein the user taps a switch enter a rhythm.

12. The musical instrument of claim 11, wherein the processor sets at least one of the onset and offset of the modified electric signals in accordance with the rhythm.

13. A method of producing sounds, comprising:

receiving electric signals that correspond to a series of sounds from a user, receiving input from the user sequentially selecting musical scales, each musical scale specifying notes that are on the musical scale; and modifying the electric signals to be constrained to correspond to notes on the currently selected musical scale.

14. The method of claim 13, further comprising setting the volume of the modified electric signals to be proportional to the volume of the sounds in the electric signals.

15. The method of claim 13, further comprising:

receiving electric signals corresponding to ambient sounds; and identifying a rhythm in the electric signals of ambient sounds.

16. The method of claim 15, further comprising setting at least one of the onset and offset of the modified electric signals in accordance with the rhythm in the ambient sounds.

17. The method of claim 13, wherein the sounds from the user are vocals sounds.

18. The method of claim 13, wherein the modified electric signals are Musical Instrument Digital Interface (MIDI) signals.

19. The method of claim 13, wherein the electric signals are modified to correspond to notes on the currently selected scale that is closest in pitch.

20. The method of claim 13, wherein the user taps a switch enter a rhythm.

21. The method of claim 20, wherein the processor sets at least one of the onset and offset of the modified electric signals in accordance with the rhythm.

22. A musical instrument, comprising:

a means for inputting a series of sounds;

a means for sequentially selecting musical scales in real-time, each musical scale specifying notes that are on the musical scale;

a means for processing the series of sounds and sequentially selected musical scales so that the sounds are constrained to notes that are on the currently selected musical scale.

23. The musical instrument of claim 22, wherein the volume of the notes is set to be proportional to the volume of the series of sounds.

24. The musical instrument of claim 22, further comprising a means for receiving ambient sounds.

25. The musical instrument of claim 24, further comprising a means for detecting a rhythm in the ambient sounds.

26. The musical instrument of claim 25, wherein at least one of the onset and offset of the notes is adjusted in accordance with the detected rhythm.

27. The musical instrument of claim 22, wherein the sounds are constrained to notes that are closest in pitch on the currently selected musical scale.

28. The musical instrument of claim 22, further comprising a switch for manually inputting a rhythm.

29. The musical instrument of claim 28, wherein the processing means sets at least one of the onset and offset of the sounds in accordance with the rhythm.

* * * * *